US005760746A

United States Patent [19]

Kawahata

[11] Patent Number: 5,760,746

[45] Date of Patent: Jun. 2, 1998

[54] SURFACE MOUNTING ANTENNA AND COMMUNICATION APPARATUS USING THE SAME ANTENNA

[75] Inventor: Kazunari Kawahata, Kyoto, Japan

[73] Assignee: Murata Manufacturing Co., Ltd., Kyoto-fu, Japan

[21] Appl. No.: 718,282

[22] Filed: Sep. 20, 1996

[30] Foreign Application Priority Data

Sep. 29, 1995 [JP] Japan ..... 7-253423

[51] Int. Cl.[6] ..... H01Q 1/24; H01Q 1/38

[52] U.S. Cl. ..... 343/702; 343/700 MS; 343/848

[58] Field of Search ..... 343/700 MS, 702, 343/731, 825, 829, 895, 850, 857, 848, 849; H01Q 1/24, 1/38

[56] References Cited

U.S. PATENT DOCUMENTS 5,442,366 8/1995 Sanford ..... 343/700 MS
5,455,596 10/1995 Higashiguchi et al. ..... 343/700 MS

FOREIGN PATENT DOCUMENTS 0332139 9/1989 European Pat. Off. .
0383292 8/1990 European Pat. Off. .
0621653 10/1994 European Pat. Off. .
0637094 2/1995 European Pat. Off. .

*Primary Examiner*—Hoanganh T. Le
*Attorney, Agent, or Firm*—Ostrolenk, Faber, Gerb & Soffen, LLP

[57] ABSTRACT

A surface mounting antenna in which non-contact excitation can be achieved via a capacitor, and easy impedance matching can be provided even when the antenna is downsized. A communication apparatus loaded with the above antenna is also disclosed. A radiation electrode is disposed on the obverse surface of a substrate. A ground electrode is formed on substantially the overall area of the reverse surface of the substrate. The radiation electrode is connected at one end to the ground electrode via a first end surface of the substrate, and extends at the other end to the portion adjacent to a second end surface opposedly facing the first end surface so as to form a free end. An excitation electrode is disposed to face the forward end of the free end of the radiation substrate across a gap g and to extend from the obverse surface of the substrate to the reverse surface via the second end surface of the substrate.

25 Claims, 4 Drawing Sheets

SURFACE MOUNTING ANTENNA AND COMMUNICATION APPARATUS USING THE SAME ANTENNA

BACKGROUND OF THE INVENTION

1. Field of the Invention

The present invention relates to a surface mounting antenna for use in mobile communication apparatus, such as cellular mobile telephones and radio Local Area Networks (LAN). The invention also relates to a communication apparatus using the above type of antenna.

2. Description of the Related Art

A typical surface mounting antenna of the prior art, in particular, a λ/4-type surface-mounting patch antenna, is shown in FIG. 7. A radiation electrode 10 is disposed at the central portion of the obverse surface of a dielectric substrate 8, and a ground electrode 9 is provided on the overall reverse surface of the substrate 8. The radiation electrode 10 is connected to the ground electrode 9 via a plurality of short-circuit pins 11 located at one edge of the radiation electrode 10. A feeding pin 12 is further disposed adjacent to the short-circuit pins 11.

However, the λ/4-type surface-mounting patch antenna of the above known type encounters the following problem. In a downsized antenna of this type, the feeding pin 12 is placed in proximity to the short-circuit pins 11, thus making it difficult to provide impedance matching due to an inductance of the feeding pin 12, and also causing a variation in the resonant frequency. Further, the sensitivity of a communication apparatus loaded with the above known type of surface-mounting patch antenna is decreased because of a deviation of the resonant frequency.

SUMMARY OF THE INVENTION

Accordingly, it is an object of the present invention to provide a surface mounting antenna in which non-contact excitation can be performed via a capacitor, and ease of impedance matching can be provided even when the antenna is downsized. It is also an object to provide a communication apparatus using the above type of antenna.

In order to achieve the above object, according to one aspect of the present invention, there is provided a surface mounting antenna comprising: a substrate; a ground electrode disposed on the substantially overall area of one main surface of the substrate; a stripline radiation electrode having a free end, disposed at least on the other main surface of the substrate and connected to the ground electrode; and an excitation electrode disposed on at least any one of the side surfaces of the substrate, wherein a gap formed between the free end of the radiation electrode and a forward end of the excitation electrode is disposed on the other main surface or any one of the side surfaces of the substrate.

According to another aspect of the present invention, there is provided a surface mounting antenna comprising: a substrate; a ground electrode disposed on substantially the overall area of one main surface of the substrate; a stripline radiation electrode disposed on the other main surface of the substrate, and positioned at one end adjacent to one edge of the substrate so as to form a free end and connected at the other end to the ground electrode; and an excitation electrode disposed near the edge of the substrate, facing the free end of the radiation electrode across a gap, and being disposed on a side surface of the substrate, wherein the excitation electrode and the radiation electrode are electromagnetically coupled to each other through a capacitor generated in the gap.

According to a further aspect of the present invention, there is provided a surface mounting antenna comprising: a substrate; a ground electrode disposed on substantially the overall area of one main surface of the substrate; a stripline radiation electrode disposed on the other main surface of the substrate and extending at one end to a first side surface of the substrate to form a free end and being connected at the other end to the ground electrode; and an excitation electrode disposed on the first side surface, facing the free end of the radiation electrode across a gap, wherein the excitation electrode and the radiation electrode are electromagnetically coupled to each other through a capacitor generated in the gap.

According to the surface mounting antenna disclosed in any one of the above-described aspects of the present invention, the radiation electrode may be partially or completely bent in the form of a U-shape or a meandering shape.

The present invention also provides a communication apparatus provided with a surface mounting antenna disclosed in any one of the aspects of the present invention.

In this manner, according to the present invention, a gap is provided between the free end of the radiation electrode and the forward end of the excitation electrode, so that the two elements can be electromagnetically coupled to each other via a capacitor formed in the gap. Thus, non-contact excitation can be achieved, and also, easy impedance matching can be provided. This gap can be formed on the main surface or on the side surface of the substrate so as to increase the flexibility of the design of the antenna, thereby enhancing easy control and adjustments of the gap. Further, the radiation electrode may be lengthened by forming it in a U-shape or a meandering shape, thereby making it possible to further downsize the antenna.

A communication apparatus loaded with the above type of surface mounting antenna is advantageous because only the shortest minimal wiring is required to connect the antenna to a high-frequency circuit mounted on the circuit board of the apparatus that processes signals input from and output to the antenna, and also because variations in the frequency caused when the antenna is mounted on the apparatus can be reduced.

Other features and advantages of the present invention will become apparent from the following description of the invention which refers to the accompanying drawings.

DETAILED DESCRIPTION OF EMBODIMENTS OF THE INVENTION

Embodiments of the present invention will now be described with reference to the drawings.

Figure 1:
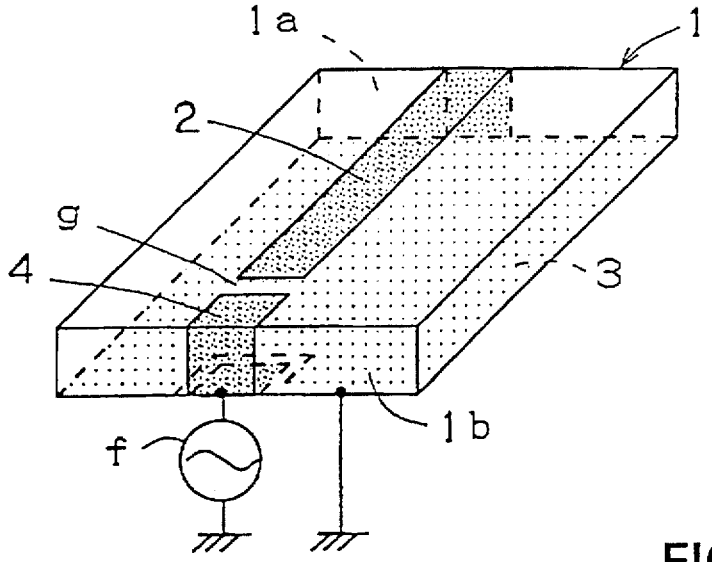
FIG. 1 is a perspective view of a surface mounting antenna according to a first embodiment of the present invention.

Referring to FIG. 1 illustrating a first embodiment of the present invention, a rectangular substrate generally indicated by 1 formed of a dielectric material, such as ceramics, resin or the like, or a magnetic material, has a stripline radiation electrode 2 having an approximately λ/4-length on the surface of the substrate 1. This radiation electrode 2 extends at one end to the portion adjacent to a first side surface 1*b* of the substrate 1 so as to form a free end and is connected at the other end to a ground electrode 3 formed on the reverse surface of the substrate 1 via a side surface la opposedly facing the first side surface 1*b* of the substrate 1. An excitation electrode 4 is disposed adjacent to the first side surface 1*b* of the substrate 1, facing the radiation electrode 2 across a gap. This electrode 4 extends from side surface 1*b* opposedly facing the above-described side surface 1*a* to the reverse surface of the substrate 1 and is electrically insulated from the ground electrode 3 by virtue of the material of the substrate 1. The excitation electrode 4 and the radiation electrode 2 are electromagnetically coupled to each other due to a capacitor generated in the gap g.

The electrical equivalent circuit at the resonant frequency of the substrate 1 constructed as described above can be indicated, such as shown in FIG. 5. More specifically, a high-frequency signal f, a capacitor C formed in the gap g, and an inductor L and a radiation resistor R generated due to the radiation electrode 2 are connected in series to each other via ground. The high-frequency signal f applied to the excitation electrode 4 is electromagnetically coupled to the radiation electrode 2 because of the capacitor C generated in the gap g, thereby radiating as radio waves.

Figure 2:
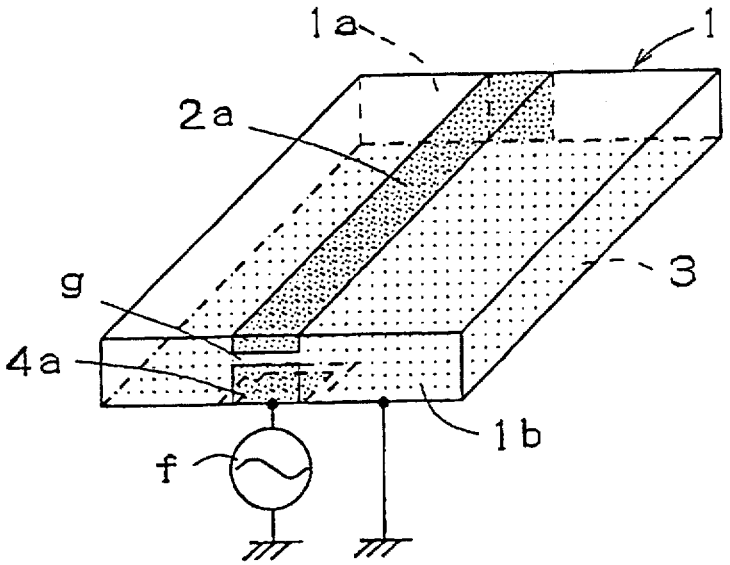
FIG. 2 is a perspective view of a surface mounting antenna according to a second embodiment of the present invention.
Figure 5:
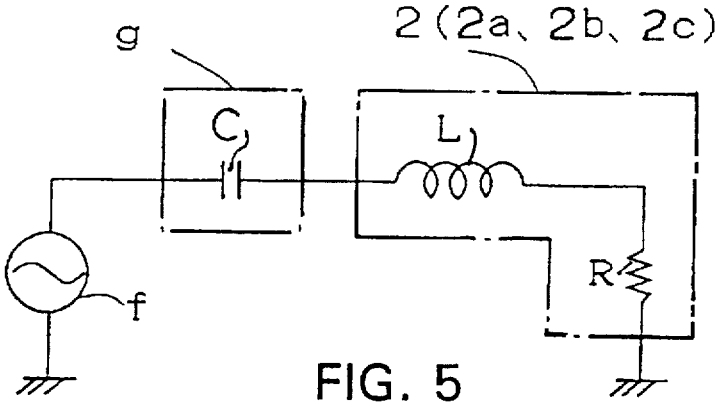
FIG. 5 is a diagram of an electrical equivalent circuit of the respective embodiments shown in FIGS. 1 through 4.

An explanation will now be given of a second embodiment of the present invention with reference to FIG. 2. The second embodiment differs from the first embodiment in that the free end of the radiation electrode 2*a* having an approximately λ/4-length is extended to the side surface 1*b* opposedly facing the side surface 1*a*, and a gap g is thus formed between the free end of the electrode 2*a* and the excitation electrode 4*a* on the side surface 1*b*. With this arrangement, frequency adjustments can be easily made by varying the size of the gap g. The other constructions are similar to those of the first embodiment. The same and corresponding elements as those explained in the first embodiment are designated by like reference numerals and an explanation thereof will thus be omitted. The electrical equivalent circuit of this antenna can also be indicated as shown in FIG. 5, as in the previous embodiment.

Figure 3:
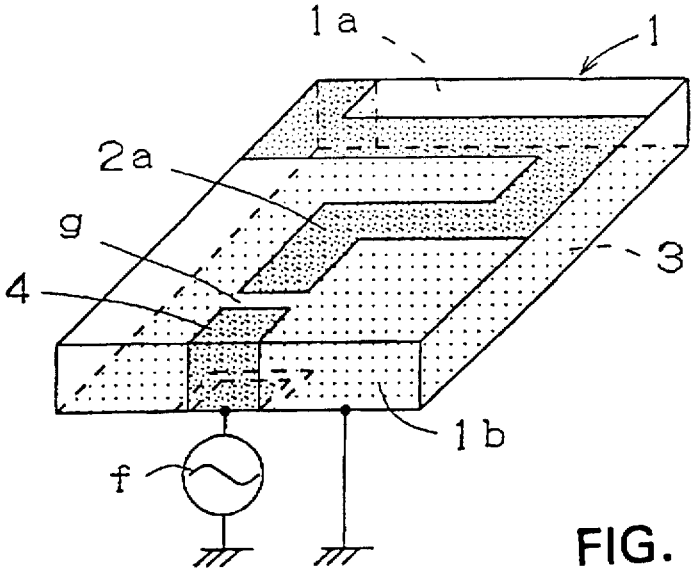
FIG. 3 is a perspective view of a surface mounting antenna according to a third embodiment of the present invention.

A third embodiment of the present invention will now be described with reference to FIG. 3. The third embodiment is different from the first embodiment in that the radiation electrode 2*b* having an approximately λ/4-length is lengthened by bending it in the form of a meandering shape. The resulting antenna can thus cope with lower frequencies with the same chip size as the first embodiment. This makes it possible to downsize the chip size at the same frequency as the first embodiment employed. The other constructions are similar to those of the first embodiment. The same and corresponding elements as those described in the first embodiment are indicated by like reference numerals, and an explanation thereof will thus be omitted. The electrical equivalent circuit of this antenna can also be designated as illustrated in FIG. 5, as in the first embodiment.

Figure 4:
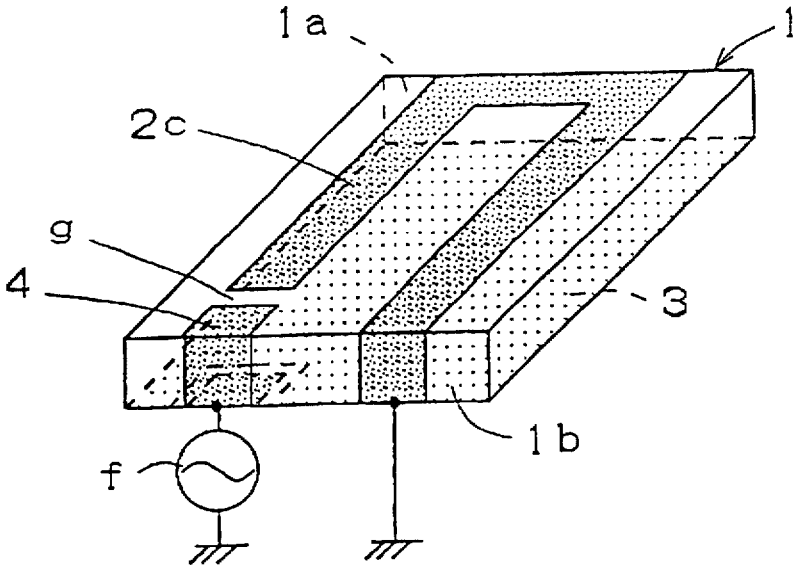
FIG. 4 is a perspective view of a surface mounting antenna according to a fourth embodiment of the present invention.

An explanation will now be given of a fourth embodiment of the present invention while referring to FIG. 4. This embodiment differs from the first embodiment in that the radiation electrode 2*c* having an approximately λ/4-length is formed in a U shape, and the connecting portion between the radiation electrode 2*c* and the ground electrode 3 is placed on the same side surface 1*b* on which the excitation electrode 4 is disposed. In this embodiment, as well as in the third embodiment, the radiation electrode 2*c* is lengthened in the U shape, thereby making it possible to downsize the chip. The other constructions are similar to those of the first embodiment. The same and corresponding elements as those described in the first embodiment are designated by like reference numerals, and an explanation thereof will thus be omitted. The electrical equivalent circuit of this antenna can also be indicated as shown in FIG. 5, as in the first embodiment.

In the foregoing embodiments, the connecting portion between the radiation electrode and the ground electrode is formed on the same side surface on which the excitation electrode is disposed or on the opposedly-facing side surface. Alternatively, the connecting portion and the excitation electrode may be formed on side surfaces adjacent to each other.

Figure 6:
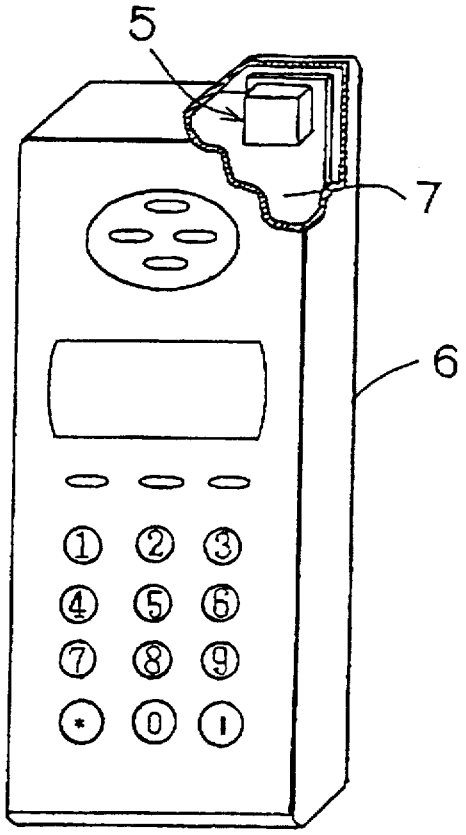
FIG. 6 is a perspective view of a communication apparatus of the present invention.
Figure 7:
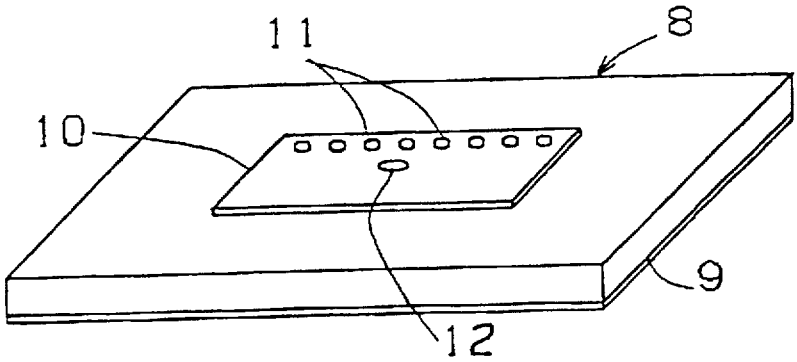
FIG. 7 PRIOR ART
FIG. 7 is a perspective view of a conventional surface mounting antenna.

FIG. 6 illustrates the surface mounting antenna described in the above-described embodiments being mounted on a communication apparatus. A surface mounting antenna 5 is mounted on a printed circuit board (or its sub board) 7 of a communication apparatus 6 by soldering the ground electrode and the excitation electrode thereto.

As will be clearly understood from the foregoing description, the present invention offers the following advantages.

A gap is provided between a free end of the radiation electrode and the excitation electrode, and the two elements are electromagnetically coupled to each other via a capacitor formed in this gap, thereby achieving non-contact excitation. Even when the chip antenna is downsized, impedance matching can be easily provided due to the absence of a feeding pin. The above-described gap can be formed on the main surface or on the side surface of the substrate so as to increase the flexibility of the design of the antenna, thereby enhancing easy control and adjustments of the gap. Further, the radiation electrode may be lengthened by forming it in the U or meandering shape, thereby enabling the antenna itself to be downsized.

A communication apparatus loaded with the above type of surface mounting antenna is advantageous because only the shortest minimal wiring is required to connect the antenna to a high-frequency circuit mounted on the circuit board of the apparatus that processes signals input from and output to the antenna, and also because variations in the frequency caused when the antenna is mounted on the apparatus can be reduced.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A surface mounting antenna comprising:

a parallelopiped substrate having first and second opposed main surfaces and four side surfaces each connecting the main surfaces;

a ground electrode disposed on substantially the overall area of the first main surface of said substrate;

a stripline radiation electrode having a free end and being disposed at least on the second main surface of said substrate and connected to said ground electrode; and an excitation electrode disposed on a surface of said substrate and having a forward end;

a gap formed between the free end of said radiation electrode and the forward end of said excitation electrode.

2. A surface mounting antenna according to claim 1, wherein the gap is disposed on the second main surface.

3. A surface mounting antenna according to claim 1, wherein the gap is disposed on a side surface of the substrate.

4. A surface mounting antenna according to claim 1, wherein said radiation electrode is at least partly bent in the form of one of a U-shape and a meandering shape.

5. A surface mounting antenna comprising:

a parallelopiped substrate having first and second opposed main surfaces and four side surfaces each connecting the main surfaces;

a ground electrode disposed on substantially the overall area of the first main surface of said substrate;

a stripline radiation electrode disposed on the second main surface of said substrate, and positioned at a first end adjacent to an edge of said substrate so as to form a free end and connected at a second end to said ground electrode; and an excitation electrode disposed near said edge of said substrate, facing said free end of said radiation electrode across a gap, and being disposed on a side surface of said substrate;

wherein said excitation electrode and said radiation electrode are electromagnetically coupled to each other through a capacitor generated in said gap.

6. A surface mounting antenna according to claim 5, wherein the side surface comprises one of a first side surface and a second side surface opposedly facing the first side surface.

7. A surface mounting antenna according to claim 5, wherein said radiation electrode is at least partly bent in the form of one of a U-shape and a meandering shape.

8. A surface mounting antenna according to claim 5, wherein the gap is disposed on said second main surface.

9. A surface mounting antenna according to claim 5, wherein the gap is disposed on a side surface.

10. A surface mounting antenna comprising:

a parallelopiped substrate having first and second opposed main surfaces and four side surfaces each connecting the main surfaces;

a ground electrode disposed on substantially the overall area of the first main surface of said substrate;

a stripline radiation electrode disposed on the second main surface of said substrate and extending at a first end to a first side surface of said substrate to form a free end and being connected at a second end to said ground electrode; and an excitation electrode disposed on said first side surface, facing said free end of said radiation electrode across a gap;

wherein said excitation electrode and said radiation electrode are electromagnetically coupled to each other through a capacitor generated in said gap.

11. A surface mounting antenna according to claim 10, wherein said radiation electrode is at least partly bent in the form of one of a U-shape and a meandering shape.

12. A surface mounting antenna according to claim 10, wherein the gap is disposed on said first side surface.

13. A communication apparatus provided with a surface mounting antenna, the antenna comprising:

a parallelopiped substrate having first and second opposed main surfaces and four side surfaces each connecting the main surfaces;

a ground electrode disposed on substantially the overall area of the first main surface of said substrate;

a stripline radiation electrode having a free end and being disposed at least on the second main surface of said substrate and connected to said ground electrode; and an excitation electrode disposed on a side surface of said substrate and having a forward end;

a gap formed between the free end of said radiation electrode and the forward end of said excitation electrode.

14. The apparatus according to claim 13, wherein the gap is disposed on the second main surface.

15. The apparatus according to claim 13, wherein the gap is disposed on a side surface of the substrate.

16. The apparatus according to claim 13, wherein said radiation electrode is at least partly bent in the form of one of a U-shape and a meandering shape.

17. A communication apparatus provided with a surface mounting antenna, the antenna comprising:

a parallelopiped substrate having first and second opposed main surfaces and four side surfaces each connecting the main surfaces;

a ground electrode disposed on substantially the overall area of the first main surface of said substrate;

a stripline radiation electrode disposed on the second main surface of said substrate, and positioned at a first end adjacent to an edge of said substrate so as to form a free end and connected at a second end to said ground electrode; and an excitation electrode disposed near said edge of said substrate, facing said free end of said radiation electrode across a gap, and being guided to a side surface of said substrate;

wherein said excitation electrode and said radiation electrode are electromagnetically coupled to each other through a capacitor generated in said gap.

18. The apparatus according to claim 17, wherein the end surface comprises one of a first end surface and a second end surface opposedly facing the first side surface.

19. The apparatus according to claim 17, wherein said radiation electrode is at least partly bent in the form of one of a U-shape and a meandering shape.

20. The apparatus according to claim 17, wherein the gap is disposed on said second main surface.

21. The apparatus according to claim 17, wherein the gap is disposed on an end surface.

22. A communication apparatus loaded with a surface mounting antenna, the antenna comprising:

a parallelopiped substrate having first and second opposed main surfaces and four side surfaces each connecting the main surfaces;

a ground electrode disposed on substantially the overall area of the first main surface of said substrate;

a stripline radiation electrode disposed on the second main surface of said substrate and extending at a first end to a first side surface of said substrate to form a free end and being connected at a second end to said ground electrode; and an excitation electrode disposed on said first side surfaces facing said free end of said radiation electrode across a gap;

wherein said excitation electrode and said radiation electrode are electromagnetically coupled to each other through a capacitor generated in said gap.

23. The apparatus according to claim 22, wherein said radiation electrode is at least partly bent in the form of one of a U-shape and a meandering shape.

24. The apparatus according to claim 22, wherein the gap is disposed on said first side surface.

25. The apparatus according to claim 22, wherein the gap is disposed on said second main surface.

* * * * *